US009468262B2

(12) United States Patent
Caron

(10) Patent No.: US 9,468,262 B2
(45) Date of Patent: Oct. 18, 2016

(54) DECORATIVE LOCKING DEVICE FOR A SHOELACE

(71) Applicant: Christelle Caron, Gagny (FR)

(72) Inventor: Christelle Caron, Gagny (FR)

(73) Assignee: Christelle Caron (FR)

( * ) Notice: Subject to any disclaimer, the term of this patent is extended or adjusted under 35 U.S.C. 154(b) by 161 days.

(21) Appl. No.: 14/490,809

(22) Filed: Sep. 19, 2014

(65) Prior Publication Data

US 2016/0081432 A1 Mar. 24, 2016

(51) Int. Cl.
*A43C 7/00* (2006.01)
*A43C 11/24* (2006.01)

(52) U.S. Cl.
CPC ..... *A43C 11/24* (2013.01); *A43C 7/005* (2013.01); *Y10T 24/3705* (2015.01)

(58) Field of Classification Search
CPC .... A43C 7/00; A43C 7/005; Y10T 24/3703; Y10T 24/3705; Y10T 24/3713
IPC ..... A43C 7/00, 7/005
See application file for complete search history.

(56) References Cited

U.S. PATENT DOCUMENTS 4,514,882 A * 5/1985 Lavielle ..... B65D 67/02 24/16 PB
4,715,094 A * 12/1987 Herdman ..... A43C 7/005 24/712.3
5,022,127 A * 6/1991 Ang ..... A43C 7/005 24/712.2
5,226,892 A * 7/1993 Boswell ..... A61M 5/1418 128/DIG. 26

FOREIGN PATENT DOCUMENTS

| | | | | |
|---|---|---|---|---|
| FR | 2987983 A1 * | 9/2013 | ..... | A43C 7/005 |
| GB | EP 1417903 A1 * | 5/2004 | ..... | A43C 7/04 |
| JP | 2005218813 A * | 8/2005 | | |
| KR | WO 0200053 A1 * | 1/2002 | ..... | A47C 7/005 |
| KR | 20090008931 U * | 9/2009 | | |
| NL | 2004467 C * | 1/2011 | ..... | A43C 7/005 |

* cited by examiner

*Primary Examiner* — Robert J Sandy

(57) ABSTRACT

A one-piece locking device for a shoelace. The locking device includes a top portion hingeably connected to a bottom portion proximate a first end of the top and bottom portions. A shoelace coupling opening is located on a bottom surface of the bottom portion. A hook and latch mechanism is formed by a hook and latch, one each of which is disposed proximate a second end of the top and bottom portions. One or more shoelace clamping bars are located on a bottom surface of the top portion and a top surface of the bottom portion which together serve to clamp and retain a shoelace. The top portion also includes one or more openings configured for interconnecting with one or more corresponding protrusions on the bottom surface of a decorative element or RFID type chip. The decorative element is selectable by a user to provide visual decoration of the locking device.

10 Claims, 4 Drawing Sheets

55
53
114
76
76
76
114
100
50
70
60
50
70
60
110

100

DECORATIVE LOCKING DEVICE FOR A SHOELACE

TECHNICAL FIELD

The present invention is in the field of footwear laces and more particularly, it relates to a device for locking a shoelace and keeping the shoelace from coming apart with such a locking device having a decorative top portion.

BACKGROUND INFORMATION

Maintaining a shoe on the foot typically involves typing show laces. This can be realized multiple ways, including setting a lace threaded into eyelets of the shoe, along the neck or top portion of the shoe. To finalize the securing of the show to the foot, the two ends of the show laces are made into loops which are then tied together. The loop in the shoelace offers many advantages, including good retention of the shoe on the foot.

A major drawback in standard shoelaces resides in the fact that the ends of the shoelace frequently come loose, until completely unraveled. The user then runs a risk of falling if it walks on the undone lace, or the shoelace binds in a non-desirable location, for example in the pedals of a bicycle. It is thus necessary to re-lace the shoelace. Constant re-lacing can be problematic, especially for children who cannot yet make a loop, and for disabled persons, or for sports as such an operation requires a stop in the sporting activity.

To overcome this drawback, it was suggested by the prior art, a locking device for shoelaces. Such a device has especially been proposed by the present inventor in the document FR-A-25 2958125. This locking device is present in the form of a clamp anchoring means provided on the lace, this clamp being adapted to close around the ends and a bit of a loop extending from the shoelace and locked in this closed position. This device allows advantageously to block or retain the lace so as to keep it from unraveling. The present invention aims to improve the locking devices of shoelace proposed by the prior art, more particularly in terms of performance, to ensure that the particular blocking means remains operable including when exerting a pull on one strand of the shoelace and/or loop extending from the lace.

SUMMARY

To this end, the present invention proposes a device for blocking or holding a shoelace, including the type of so-called shoelace with a loop, that is to say having two loops and two free strands/ends of lace extending from the top of the shoe. This device presents itself as a clamp or locking device.

The invention features a shoelace locking device, comprising a single piece locking device including a bottom portion having a first end, a second end, a top surface and a bottom surface, as well as a top portion having a first end, a second end, a top surface and a bottom surface. The first end of the top portion is hingeably coupled to the first end of the bottom portion. The second end of the top portion and the second end of the bottom portion are configured for together forming a hook and latch mechanism. The hook and latch mechanism is configured for retaining the top portion in a closed position relative to the bottom portion, and wherein the bottom surface of the top portion is maintained at a predetermined distance from the top surface of the bottom portion.

The bottom surface of the bottom portion includes a shoelace coupling opening, sized and configured for allowing the shoelace locking device to be inserted on a shoelace. The bottom surface of the top portion includes at least one shoelace clamping bar and the top surface of the bottom portion also includes at least one shoelace clamping bar.

In one embodiment, the bottom surface of the top portion includes one shoelace clamping bar while the top surface of the bottom portion includes two shoelace clamping bars. In this embodiment, the one shoelace clamping bar disposed on the bottom surface of the top portion is located along a longitudinal centerline of the bottom surface of the top portion while in this embodiment, the two shoelace clamping bars disposed on the top surface of the bottom portion includes a first one of the two shoelace clamping bars disposed proximate a first longitudinal edge of the top surface of the bottom portion and a second one of the two shoelace clamping bars is disposed proximate a second longitudinal edge of the top surface of the bottom portion.

In another embodiment, the bottom surface of the top portion includes two shoelace clamping bars while the top surface of the bottom portion includes one shoelace clamping bar. In this embodiment, the two shoelace clamping bars disposed on the bottom surface of the top portion includes a first one of the two shoelace clamping bars disposed proximate a first longitudinal edge of the bottom surface of the top portion, and a second one of the two shoelace clamping bars is disposed proximate a second longitudinal edge of the bottom surface of the top portion. In this embodiment, the one shoelace clamping bar disposed on the top surface of the bottom portion is located along a longitudinal centerline of the top surface of the bottom portion.

In one embodiment, the hook and latch mechanism includes a hook element located on the second end of the bottom portion and a latch element hingeably coupled to the second end of the top portion. In another embodiment, the hook and latch mechanism includes a hook element located on the second end of the top portion and a latch element located proximate the second end of the bottom portion. In yet another element, the top portion includes at least one opening configured for interconnecting with a protrusion located on a bottom surface of a decorative element. The invention contemplates two or more openings in the top surface, both configured for interconnecting with first and second protrusions located on a bottom surface of a decorative element.

BRIEF DESCRIPTION OF THE DRAWINGS

These and other features and advantages of the present invention will be better understood by reading the following detailed description, taken together with the drawings wherein:

FIG. 7 shows the device of FIG. 6 in a closed position;

DETAILED DESCRIPTION OF THE PREFERRED EMBODIMENTS

Figure 1:
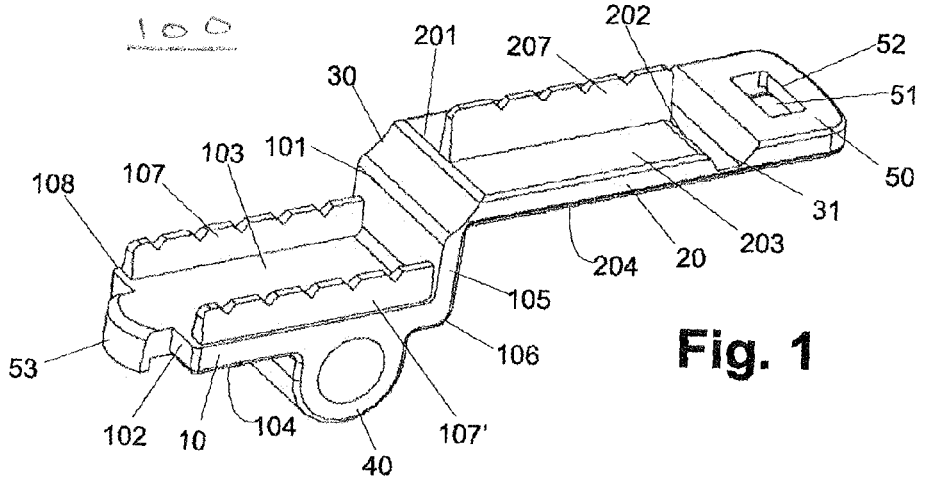
FIG. 1 is a plan view of a device according to one embodiment of the invention in the open position.

A locking device 100, FIG. 1 for a shoelace according to a first embodiment of the invention is represented is shown in the open position. This device is presented in general form of a clamp having a lower portion (also referred to herein as branch, leg or segment) 10 and an upper portion (also referred to herein as a branch or leg or segment) 20, each substantially parallel to one another and generally rectangular in shape and relatively thin. Each of these branches 10, 20 has a first longitudinal end 101, 201 hingeably coupled to one another and a second, opposite longitudinal free end 102, 202 respectively. Each branch 10, 20 further comprises an inner face or surface 103, 203 and an opposite outer face or surface 104, 204.

The two branches 10, 20 are articulated or hinged with respect to each other around a first hinge 30 connecting the first longitudinal end 101 of the lower branch 10 and the first end 201 of the longitudinal upper branch 20. The axis of this hinge is substantially perpendicular to a longitudinal axis of each of the upper and lower branches; the longitudinal axis being defined as the axis extending between the longitudinal, opposite ends 101/102 and 201/202 of each branch.

The device 100 comprises anchoring means configured to removably anchor the device 100 on the shoe lace 61. In the preferred embodiment shown in the figures, the anchoring means comprises a feature 40 in the outer face 104 of the lower branch 10. The anchoring feature is preferably in the form of a fixed cylinder or opening 40 located under the lower arm or branch 10, wherein the cylinder or opening 40 extends substantially perpendicularly to the longitudinal axis of the lower arm 10. The opening 40 has an internal diameter 25 sufficient for being inserted over a classic shoe lace; although the diameter can be adjusted to fit any type of shoe lace desired. In the preferred embodiment, the internal diameter 25 is in the range of 3 to 6 mm. The opening 40 preferably has a smooth internal surface, so as not damage the shoe lace threaded/located on its inside.

Figure 2:
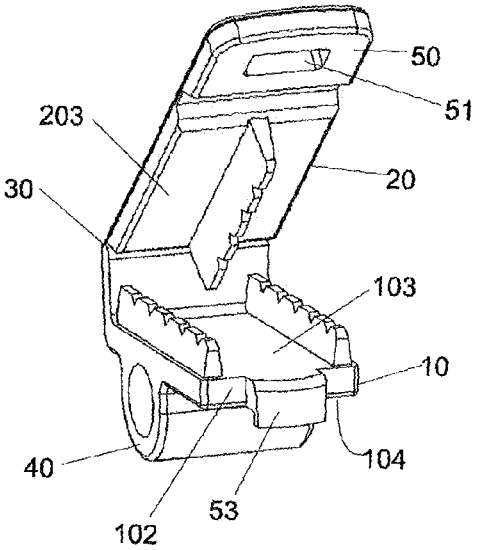
FIG. 2 shows the device of FIG. 1 in a semi-closed position.
Figure 3:
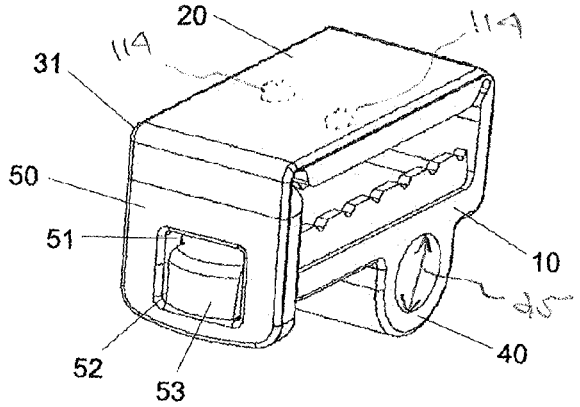
FIG. 3 represents the device of FIG. 1 in a closed position.

In the first embodiment shown in FIGS. 1-3, the lower branch 10 preferably has an L-shape, wherein upwardly turned end member 105 is disposed adjacent the first longitudinal end 101.

The length of the sole or upwardly turned end member 105 measured between the shoulder 106 of the "L" and the first longitudinal end 101 of the lower arm 10 is selected according to the dimensions of the shoe lace 61 for which the device is intended to be in worn. The thicker the diameter of the shoe lace 61 the longer the length of the upwardly turned member 105. The length is preferably for example between 4 and 9 mm.

The device 100 also comprises a locking mechanism for holding or clamping the upper branch 20 in a closed position in which the lower branch 20 and the upper branch 20 are arranged with respect to each other such that their internal surfaces 103 203 are in close proximity to and substantially parallel with each other.

The locking mechanism comprises a two-part member comprising, in the first embodiment, a tab or latch 50 extending from the free longitudinal extremity or second end 202 of the upper leg or branch 20 and a hook or protrusion or knob 53 extending from the outer face or surface 104 of the end 102 of the lower branch 10.

The tab 50 is articulated relative to the upper branch 20 about a second hinge axis 31 parallel to the axis of the first hinge 30. The tab 50 is provided with a window or opening 51 there through. The tab 50 and the window 51 are configured such that the distance between the second hinge 31 and a distal end 52 of the knob or hook 53 securely closes the device 100, that is to say, the latching mechanism applies sufficient pressure on the shoe lace 61 placed between the upper and lower branches 20, 10 respectively of the device 100 to keep the shoe lace in place and from being pulled out and coming apart.

The tab 50 is configured so that, in the closed position, a clamp is formed by the upper branch 20 folded against the longitudinal extremity 102 of the lower branch 10, in a position in which the hook 53 is engaged in the window 51.

Each of the upper and lower branches 20, 10 respectively has on its internal respective face 103, 203 one or more notched longitudinal bars 107, 107' and 207 extending substantially over the entire length of the face 103,203. These bars are arranged such that their notched surface is facing the opposite branch.

In the particular embodiment represented in FIG. 1, the lower branch 10 has two such notched bars or strips 107, 107' arranged on the inwardly facing surface 103 of the lower branch 10 proximate the two sides or edges of the inner surface 103. The upper branch 20 has one notched bar 207, which is disposed substantially along its longitudinal center line. Such an arrangement is not a limiting feature of the invention however.

The bars 107, 107' and 207 are sized in conjunction with the length of the interconnection member 105 between the upper and lower branches such that in the closed position of the clamp, there remains between the toothed upper surface of each bar 107, 107' and 207 and the inner face of the opposite branch facing each bar, a spacing of adequate size such that a shoe lace can be clamped and immobilized between this notched surface and the inner face 103/203 of the opposite branch. This spacing is for example about 1 to 3 mm.

The present invention can be implemented as a range of devices of different dimensions, adapted to different types and sizes laces. In particular, the spacing between the bars 107, 107' and 207 and the internal face 103, 203 of the opposite branch may varies from one device to another device, to accommodate shoes laces of various thicknesses.

The device 100 is represented in FIG. 1 in its open position, which is the position in which it is placed for positioning a free strand of shoe lace, preferably a free end and/or a loop extending from the lace, and placed between the lower branch 10 and the upper branch 20.

To bring the clamp into a closed position, the upper branch 20 is bent at the first hinge 30, as illustrated in FIG. 2, so as to bring the lower branch 10 and the upper branch 20 in a relative position in which their respective inner surfaces 103, 203 are opposite and proximate one another.

Once the lower and upper branches 10/20 respectively are in a relative position such that their respective inner surfaces 103, 203 are substantially parallel to each other that is to say when the upper branch 10 reaches the closed position of the clamp, as shown in FIG. 3, the tab 50 is folded, by folding the second hinge 31, in a longitudinal direction of the free extremity 102 of the lower leg 10, until the hook 53 engages in the window 51, around the distal end 52 of the bard or hook 53. The tab 50 is then immobilized by the hook 53.

The tab bears on the external face 104 of the lower branch 10, exerting pressure against to lower branch 10. Hook 53 is here regarded as an integral part of the lower branch 10.

The clamp is then securely locked in the closed position by the tab 50 engaging with the hook 53. In this position, the gap between the toothed surface of each strip 107, 107', 207 and the branch respectively opposed 20/10 is such that one strand and/or loop of shoe lace positioned between the lower branch 10 and upper branch 20 is firmly clamped between the strips 107, 107', 207 and the opposing inner surface 103/203 and any movement of the shoe lace is then prohibited.

Figure 4:
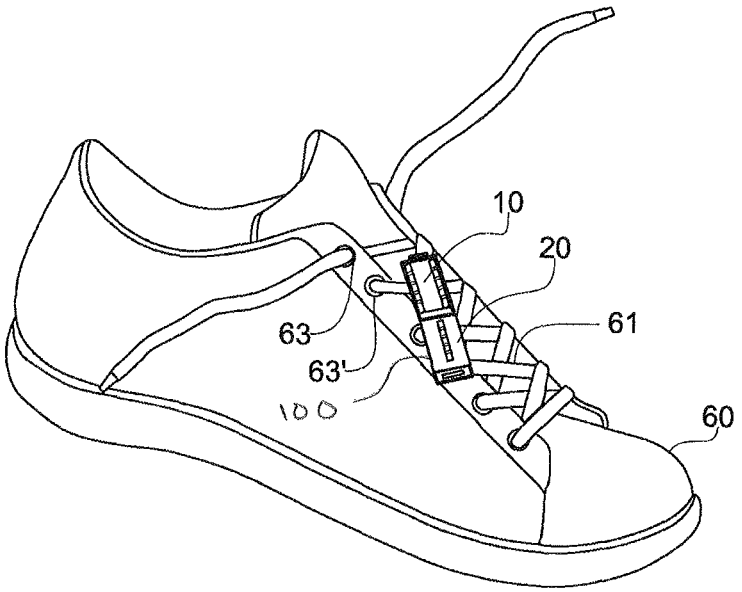
FIG. 4 illustrates schematically a device according to one embodiment of the invention on a shoe lace on a shoe.
Figure 5:
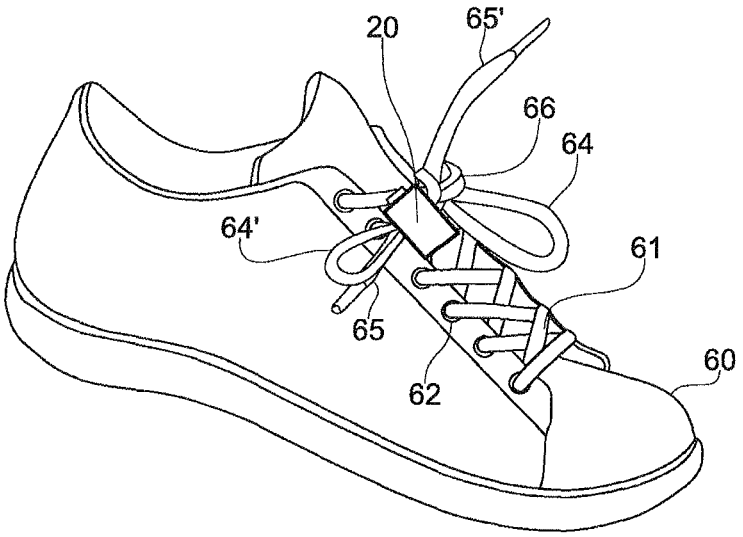
FIG. 5 illustrates the device of FIG. 4 anchored on the lace of a shoe in position and locking the shoe lace.

A locking device 100 according to the first embodiment of the invention is shown schematically in FIGS. 4 and 5 in one position on a shoe for blocking a shoelace. In these figures, shoe 60 is equipped with a shoe lace 61 in place between eyelets 62. The device locking the lace 100 is anchored by means of the loop 40 (not visible in FIGS. 4 and 5) which is disposed in the lower branch 10 as previously disclosed. Specifically, this anchoring is realized on a portion of the shoe lace 61 situated near the last or upper eyelet 63 of the shoe. As represented in the embodiment shown in FIG. 4, the anchor device 100 can be located near the second to last eyelet 63' closer to the last eyelet 63. To do this, the lace is removed from the last and second to last eyelet 63/63' and is inserted through the loop 40 of the shoe lace locking device 100. Then the shoe lace is re-inserted into the second to last 63' and last eyelets 63, as shown generally in FIG. 4, wherein the device 100 is in the open position. In this FIG. 4, the bars 107, 107' and 207 are not shown for reasons of clarity. As shown in FIG. 4, the device may be positioned such that in the open position, the tab 53 on the lower branch 10 is located closer to the ankle of the user although this is not a limitation of the present invention.

In other contemplated embodiments, the locking device 100 need not be placed at or near the last or upper shoe eyelet 63 but rather, can be located on any portion of the shoelace proximate any eyelet.

A method of blocking or locking a shoelace includes forming a classic shoe lace knot 66 forming first and second loops 64/64' in the classic way. This knot 66 is formed next to or above the anchor device 100 on the lace 61, depending on the positioning of the device on the shoe. The knot 66 forms two loops 64, 64'. A free end 65, 65' extends from each loop 64, 64' near the knot 66.

Once the knot 66 is formed, the free end 65 and the loop 64 that it is not associated with the free end are clamped between the branches of the hook and latch mechanism, and the latter is locked in the closed position. In the embodiment represented in FIG. 5, one of the two loops 64, 64' and one of the two ends 65, 65' are thus blocked in the clip 100 with only the upper branch 20 shown in the FIG in the closed position. This blockage is even stronger than it is required in the interior of the clamp, wherein the free end and loop of the shoe lace are enclosed, the force of the clamping action formed by the zigzag path between successive notched bars and the inside of their legs which are opposed.

Manipulation for setting and unsetting the locking device 100 is simple and quick to make. The lace is then firmly locked in the locking device 100 according to the invention and traction exerted on loops and/or the free ends, in particular by the spacing between the upper and lower branches 20/10, do not allow the shoe lace to become undone. The device 100, positioned on the side of the area of the shoe 60, does not cause any problem for the user wearing the shoe. When the user wants to undo his shoelace, it is sufficient to exercise a slight upward pressure on the tab 50, unhooking the tab 50 from the hook 53 unlocking the clamp so as to free the shoe lace.

Figures 5, 6:
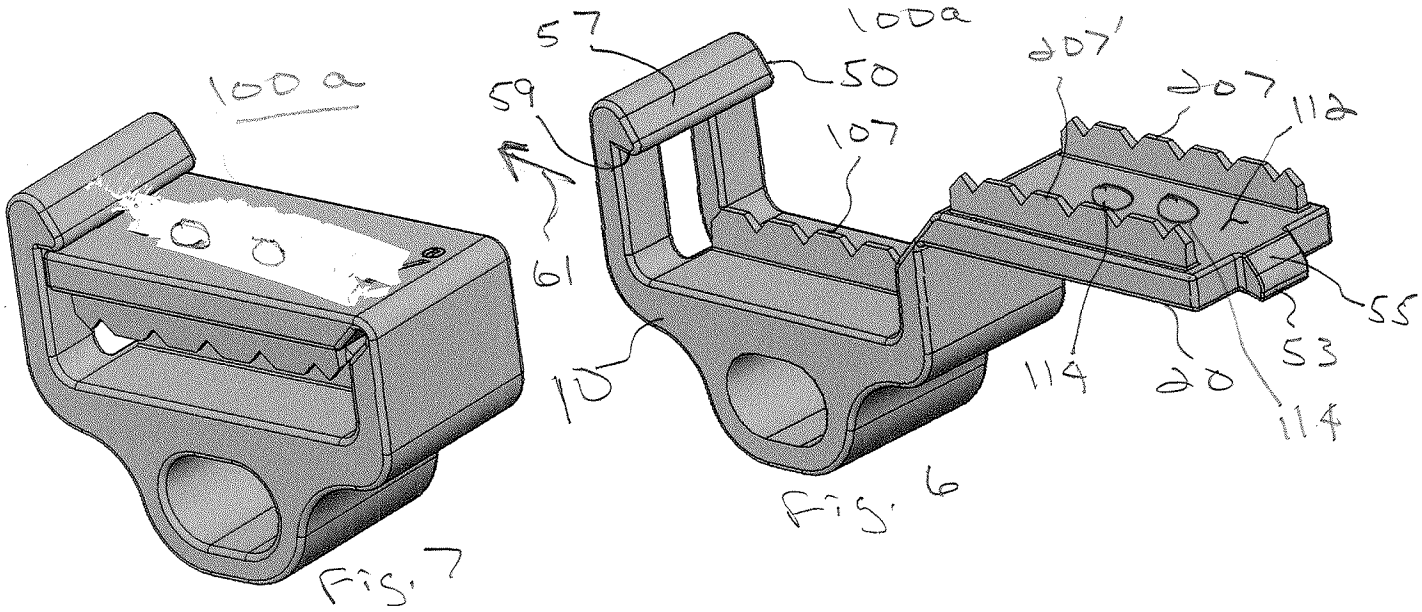
FIG. 6 is a plan view of a device according to a second embodiment of the invention in the open position.

In a second embodiment, the locking device **100*a* shown in FIGS. 6 and 7 is provided with a clamping arrangement (hook and latch mechanism) that differs slightly from that shown and described in connection with FIGS. 1-5. In this embodiment, the upper branch 20 includes tab or hook 53 which is designed to mate with the latch portion 50 coupled to the lower branch 10. In order to lock the device 100*a*, the user simply closes the upper branch 20 causing the curved surface 55 on tab 53 to easily slide against the curved surface 57 on the latch portion 50, causing the top planer surface of the tab 53 to rest against the flat plane or surface 59 of the latch portion 50, as shown in FIG. 7. This is a much easier locking motion than previously described in connection with FIGS. 1-5. In order to release the clamping force, the user simply provides a sufficient amount of lateral force in the direction shown generally by arrow 61 on the latch portion 50 to release the tab 53 and allow the upper portion 20 to return to the position shown generally in FIG. 6**.

Figure 8:
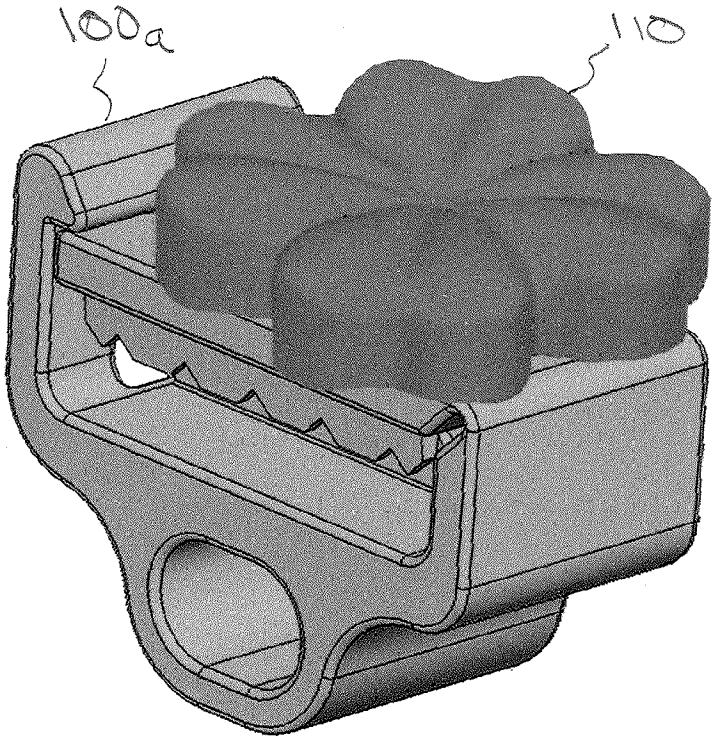
FIG. 8 is a plan view of a device according to a yet another embodiment of the invention in the closed position.
Figure 9:
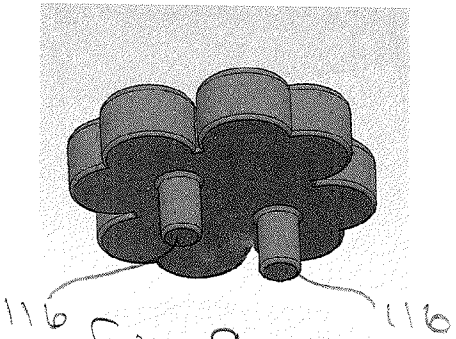
FIG. 9 is a plan bottom view of the decorative element according to one feature of the present invention.

In yet a further embodiment shown in FIGS. 8 and 9, the locking device **100*a* according to the present invention may include a decorative element 110 mounted on the upper branch 20 of the locking device 100. Such a decorative element may be utilized with either the embodiment shown in FIGS. 6 and 7 or alternatively, with the embodiment shown in FIGS. 1-5. In order to facilitate the use of a decorative element inserted into the upper branch 20 as will be described below, the notched bars 107, 107' and 207 may be reversed from that shown in FIGS. 1-3**.

As will be appreciated and clearly seen, the upper branch includes notched bars 207 and 207' while the lower branch 10 includes one notched bars 107. Providing two notched bars 207 in the upper branch 20 provides an open central area 112 which allows the provision of one or more holes or openings 114 which are designed to meet with the one or more protrusions 116 correspondingly provided in the lower portion of the decorative element 110.

In one embodiment, the entire protrusions 116 in the lower portion of the decorative element 110 (or simply the end region of the protrusion 116) may be sized (actually slightly oversized) such that they frictionally engage with the openings 114 in the upper branch 20 and must be inserted with enough force to cause the protrusion to be forced into the openings 114. In this embodiment, the user can change the decorative element 110 as often as he or she would like. In another embodiment, in order to prevent the inadvertent dislodging of the decorative element 110 from the upper branch 20, once the decorative element has been inserted into the upper branch 20 of the locking device 100, a slight heating force may be applied to the ends of the protrusions 116 causing them to melt and become widened enough to prevent the protrusions 116 from becoming returning through and being disconnected from the openings 114 in the upper branch 20 and thus making sure that the decorative element 110 will not be able to fall out of the locking device 100.

In yet another embodiment, the decorative element 110 may include or in fact be a micro-chip such as an RFID chip intending to be worn by a runner or hiker and which can be used to automatically determine the time a wearer crosses a "start" or "finish" line in an event such as a race or marathon.

All embodiments of the present invention are preferably a one piece device preferentially formed by injection molding or the like from any suitable material having sufficient rigidity to ensure a solid enclosure. For example a plastic material such as polypropylene material or a biodegradable or compostable plastic material are contemplated without limiting the invention.

The above description clearly shows that the different features and advantages that the present invention achieves the objectives it achieves. In particular, it provides a locking device for a shoe lace that is easy to use and will block or lock the shoe lace in a particularly effective way. The above description also clearly shows that one or more features of one or more embodiments may be mixed and matched with one more features as desired without departing from the spirit of the present invention. For example, as shown in dashed lines in FIG. 3, the openings 114 may be disposed on either side of the centrally located notched bar 207 disposed in the upper branch 20 of this figure. Other combinations are contemplated and are considered to be within the scope of the present invention and the abilities of someone skilled in the art.

Modifications and substitutions by one of ordinary skill in the art are considered to be within the scope of the present invention, which is not to be limited except by the allowed claims and their legal equivalents.

The invention claimed is:

1. A shoelace locking device, comprising:

a single piece locking device comprising:

a bottom portion having a first end, a second end, a top surface and a bottom surface, wherein said first end of said bottom portion extends vertically upwardly a first distance from said top surface of said bottom portion and said second end of said bottom portion extends vertically upwardly a second distance from said top surface of said bottom portion, wherein said second distance is greater than said first distance, said second end of said bottom portion including an opening extending vertically through said second end upwards towards a top edge portion of said second end of said bottom portion, said second end including a horizontal, inwardly oriented catch portion extending from said top edge portion perpendicular to said vertically oriented second end and projecting outward from said second end toward said first end; and a top portion having a first end, a second end, a top surface and a bottom surface;

wherein said first end of said top portion is hingeably coupled to said first end of said bottom portion and wherein said second end of said top portion includes a protrusion configured in terms of size and shape to inserted into said vertically extending opening in said second end of said bottom portion;

wherein said second end of said top portion including said protrusion and said second end of said bottom portion including said vertically extending opening and said horizontal, inwardly oriented catch portion extending from said top edge portion are configured for together forming a two point hook and latch mechanism, a first point of said hook and latch mechanism formed between said protrusion on said second end of said top portion and said vertically extending opening in said second end of said bottom portion, and a second point of hook and latch mechanism formed between an edge region of said top surface of said second end of said top portion and said horizontal, inwardly oriented catch portion extending from said top edge portion of said second end of said bottom portion, said two point hook and latch mechanism configured for retaining said top portion in a closed position relative to said bottom portion wherein said bottom surface of said top portion is maintained at a predetermined distance spaced apart from said top surface of said bottom portion;

wherein said bottom surface of said bottom portion includes a shoelace coupling opening, sized and configured for allowing said shoelace locking device to be inserted on a shoelace; and wherein said bottom surface of said top portion includes at least one shoelace clamping bar, and wherein said top surface of said bottom portion includes at least one shoelace clamping bar.

2. The shoelace locking device of claim 1, wherein said bottom surface of said top portion includes one shoelace clamping bar, and wherein said top surface of said bottom portion includes two shoelace clamping bars.

3. The shoelace locking device of claim 2, wherein said one shoelace clamping bar disposed on said bottom surface of said top portion is located along a longitudinal centerline of said bottom surface of said top portion.

4. The shoelace locking device of claim 3, wherein said two shoelace clamping bars disposed on said top surface of said bottom portion includes a first one of said two shoelace clamping bars disposed proximate a first longitudinal edge of said top surface of said bottom portion and a second one of said two shoelace clamping bars is disposed proximate a second longitudinal edge of said top surface of said bottom portion.

5. The shoelace locking device of claim 1, wherein said bottom surface of said top portion includes two shoelace clamping bars, and wherein said top surface of said bottom portion includes one shoelace clamping bar.

6. The shoelace locking device of claim 5, wherein said two shoelace clamping bars disposed on said bottom surface of said top portion includes a first one of said two shoelace clamping bars disposed proximate a first longitudinal edge of said bottom surface of said top portion, and a second one of said two shoelace clamping bars is disposed proximate a second longitudinal edge of said bottom surface of said top portion.

7. The shoelace locking device of claim 5, wherein said one shoelace clamping bar disposed on said top surface of said bottom portion is located along a longitudinal centerline of said top surface of said bottom portion.

8. The shoelace locking device of claim 1, wherein said top portion includes at least one opening configured for interconnecting with a protrusion located on a bottom surface of a decorative element.

9. The shoelace locking device of claim 1, wherein said top portion includes at least two openings configured for interconnecting with first and second protrusions located on a bottom surface of a decorative element.

10. The shoelace locking device of claim 1, wherein said top portion includes at least one opening configured for interconnecting with a protrusion located on a bottom surface of an RFID chip configured to be mounted on said top portion.

* * * * *